US011454435B2

(12) United States Patent
Zhang et al.

(10) Patent No.: US 11,454,435 B2
(45) Date of Patent: Sep. 27, 2022

(54) ACCUMULATOR AND HEAT EXCHANGE DEVICE HAVING ACCUMULATOR

(71) Applicant: Zhejiang Sanhua Intelligent Controls Co., Ltd, Shaoxing (CN)

(72) Inventors: Bing Zhang, Hangzhou (CN); Yun Wang, Hangzhou (CN); Ran Ding, Hangzhou (CN); Rongrong Zhang, Hangzhou (CN)

(73) Assignee: Zhejiang Sanhua Intelligent Controls Co., Ltd., Shaoxing (CN)

( * ) Notice: Subject to any disclaimer, the term of this patent is extended or adjusted under 35 U.S.C. 154(b) by 119 days.

(21) Appl. No.: 16/771,383

(22) PCT Filed: Oct. 15, 2018

(86) PCT No.: PCT/CN2018/110180
§ 371 (c)(1),
(2) Date: Jun. 10, 2020

(87) PCT Pub. No.: WO2019/119942
PCT Pub. Date: Jun. 27, 2019

(65) Prior Publication Data

US 2020/0393180 A1 Dec. 17, 2020

(30) Foreign Application Priority Data

Dec. 18, 2017 (CN) ..... 201711361811.4

(51) Int. Cl.
*F25B 43/00* (2006.01)
*F25B 39/04* (2006.01)

(52) U.S. Cl.
CPC ..... *F25B 43/006* (2013.01); *F25B 39/04* (2013.01)

(58) Field of Classification Search
CPC ..... F25B 43/006; F25B 39/04
See application file for complete search history.

(56) References Cited

U.S. PATENT DOCUMENTS 5,505,060 A * 4/1996 Kozinski ..... F25B 39/022 165/132
5,546,761 A 8/1996 Matsuo et al.
5,934,102 A 8/1999 DeKeuster et al.

FOREIGN PATENT DOCUMENTS

AU 741643 12/2001
CN 201203307 3/2009
(Continued)

OTHER PUBLICATIONS

JP-2008151420-A translation.*

*Primary Examiner* — Elizabeth J Martin
(74) *Attorney, Agent, or Firm* — Boyle Fredrickson S.C.

(57) ABSTRACT

An accumulator, including a housing and a cover body, one end of the housing being open; the housing is internally provided with an accommodating cavity, the accommodating cavity being internally provided with a filter; a peripheral wall of the housing comprises a first thick wall part, the first thick wall part being provided with an inlet channel, and one end of the inlet channel communicating with the accommodating cavity, while the other end of the inlet channel communicates with the outside; one end of an outlet channel communicates with the accommodating cavity by means of the filter, while the other end of the outlet channel communicates with an outer portion of the housing. The accumulator may be directly welded and fixed to a heat exchange core without requiring a pipeline connection, the risk of external leakage being small, and the anti-seismic performance being high.

11 Claims, 4 Drawing Sheets

(56) References Cited

FOREIGN PATENT DOCUMENTS

| | | | | | |
|---|---|---|---|---|---|
| CN | 201203309 | | | 3/2009 | |
| CN | 201331216 | | | 10/2009 | |
| CN | 103712378 | | | 4/2014 | |
| CN | 205245623 | | | 5/2016 | |
| FR | 2965337 | | | 3/2012 | |
| JP | 2006052938 | | | 2/2006 | |
| JP | 2008151420 | | | 7/2008 | |
| JP | 2008151420 | A | * | 7/2008 | ..... F25B 39/04 |
| KR | 20020078060 | | | 10/2002 | |

* cited by examiner

ACCUMULATOR AND HEAT EXCHANGE DEVICE HAVING ACCUMULATOR

CROSS-REFERENCE TO RELATED APPLICATIONS

The present application is a national phase of International Application No. PCT/CN2018/110180, titled "LIQUID COLLECTOR AND HEAT EXCHANGE DEVICE HAVING LIQUID COLLECTOR", filed on Oct. 15, 2018, which claims the benefit of Chinese patent application No. 201711361811.4, entitled "ACCUMULATOR AND HEAT EXCHANGE DEVICE HAVING ACCUMULATOR", filed with the China National Intellectual Property Administration on Dec. 18, 2017, both of which applications are incorporated herein in their entireties by this reference.

TECHNICAL FIELD

The present application relates to the technical field of refrigeration equipment, and in particular to an accumulator and a heat exchange device having the accumulator.

BACKGROUND OF THE INVENTION

A refrigeration system usually includes a compressor, a condenser, an expansion valve and an evaporator. Liquid refrigerant evaporates and absorbs heat in the evaporator and becomes a low-temperature and low-pressure gas; and the gas passes through the compressor and becomes a high-temperature and high-pressure gas. The high-temperature and high-pressure gas condenses and releases heat in the condenser, and becomes a low-temperature and high-pressure liquid, and then the low-temperature and high-pressure liquid is dried and filtered through an accumulator. The low-temperature and high-pressure liquid is throttled through the expansion valve becomes a gas-liquid two-phase, and returns to the evaporator to perform evaporation and heat absorption. Similar to these principles, these refrigeration devices are widely used in automotive air conditioners, heat pump units, multi-connected air conditioners, motor heat management and the like. By arranging the accumulator, the volume fluctuation in the refrigeration system can be balanced, and the refrigerant can also be undercooled stably.

Generally, each component of the refrigeration system is a separate component, wherein the condenser and the accumulator are connected in a form of a pipeline. In order to make the refrigerant undercooled, a heat exchanger for undercooling is additionally provided to undercool the refrigerant exiting from the accumulator. The above components all need to be connected in the form of the pipeline, which has a complex structure and needs a large installation space. The risk of external leakage is high, and the anti-seismic performance is also poor through a pipeline connection mode.

SUMMARY OF THE INVENTION

In order to solve the technical problem, an accumulator and a heat exchange device having the accumulator are provided according to the technical solution of the present application, so that the accumulator can be fixed with a heat exchange core body as a whole by welding, without the requirement for pipeline connection, the risk of external leakage is relatively small, and the anti-seismic performance is relatively high.

An accumulator is provided according to the technical solution of the present application, which includes a housing, and a filter is arranged in the housing. The housing includes a first sub-housing and a second sub-housing. An accommodating cavity is formed in the housing. The first sub-housing and the second sub-housing are sealedly fixed to form the accommodating cavity. The filter is arranged in the accommodating cavity. The housing is provided with a first thick wall portion. The first thick wall portion is located in the second sub-housing. An inlet channel and an outlet channel are formed in the first thick wall portion, one end of the inlet channel is in communication with the accommodating cavity, and another end of the inlet channel is in communication with an exterior of the housing. One end of the outlet channel is in communication with the accommodating cavity through the filter, and another end of the outlet channel is in communication with the exterior of the housing. A port of the inlet channel in communication with the exterior of the housing is arranged adjacent to a port of the inlet channel in communication with the exterior of the housing.

A heat exchange device is further provided according to the technical solution of the present application. The heat exchange device includes a heat exchange core body and an accumulator. The heat exchange core body includes multiple mutually stacked plates, and multiple channels are formed between the mutually stacked plates, where a part of the multiple channels are formed as a first fluid channel, and another part of the multiple channels are formed as a second fluid channel. A partition plate is further arranged in the heat exchange core body, the first fluid channel is divided into a first section and a second section through the partition plate. The first section includes a first fluid collecting channel and a second fluid collecting channel. The second section includes a third fluid collecting channel and a fourth fluid collecting channel. The second fluid collecting channel is in communication with the inlet channel, and the outlet channel is in communication with the third fluid collecting channel through a pipeline.

According to the accumulator and the heat exchange device having the accumulator, the accumulator and the heat exchange core body can be directly fixed by welding, which has a simple processing, a convenient installation, a compact structure. Besides, since the pipeline connection is reduced, the risk of external leakage is relatively small, and the anti-seismic performance is relatively high.

DETAIL DESCRIPTION OF THE EMBODIMENTS

The technical solutions of the present application are described in detail below in combination with the drawings and specific embodiments.

Figure 1:
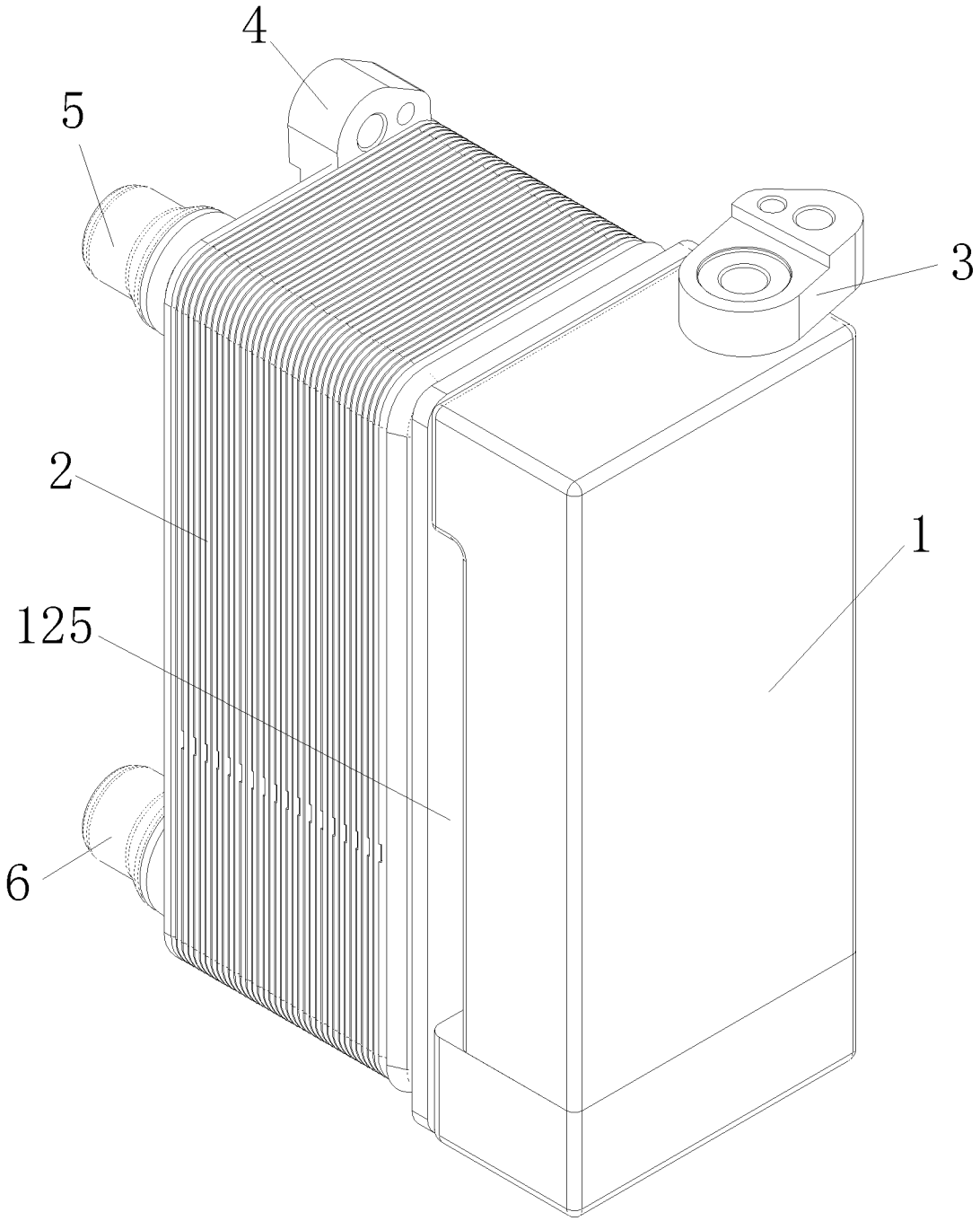
FIG. 1 is a schematic front view of a heat exchange device according to an embodiment of the present application.
Figure 2:
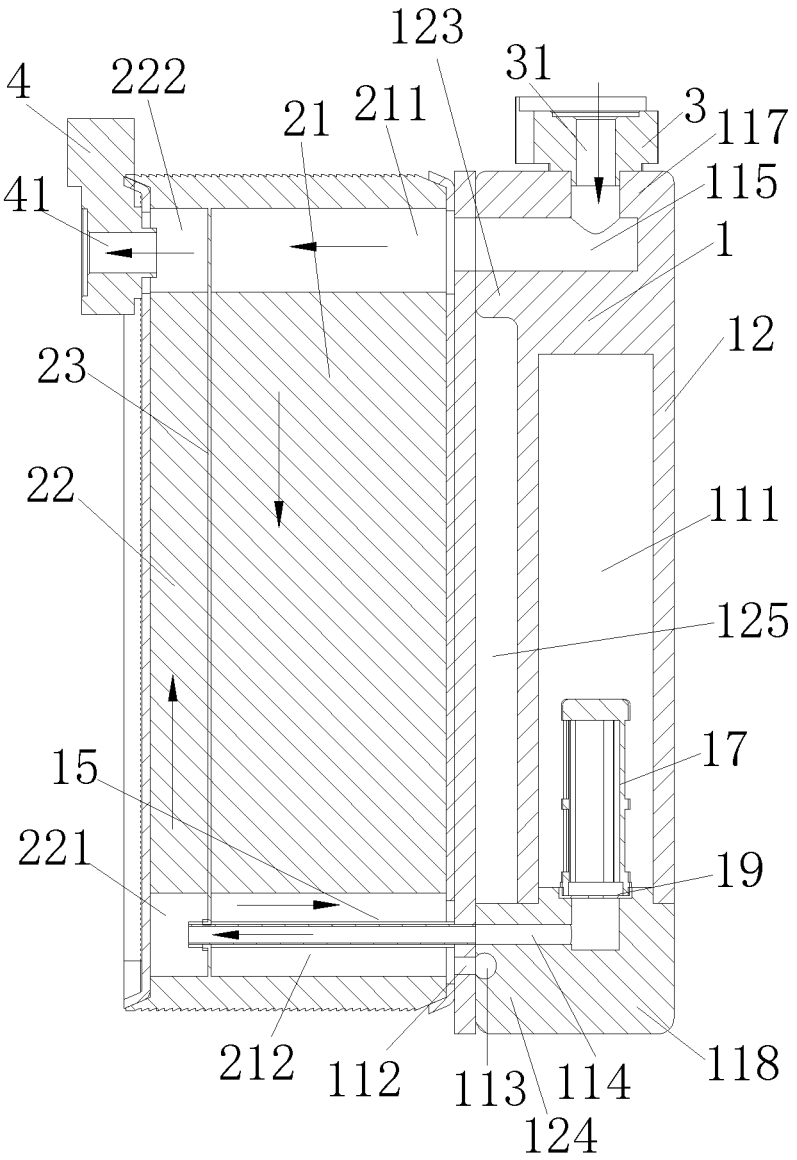
FIG. 2 is a schematic sectional view of the heat exchange device shown in FIG. 1.

As shown in FIGS. 1 and 2, in the present embodiment, the heat exchange device includes a heat exchange core body 2 and an accumulator 1 fixed to the heat exchange core body, the heat exchange core body and the accumulator are mutually fixed by welding. The accumulator 1 is provided with a first adapter seat 3, the heat exchange core body 2 is provided with a second adapter seat 4, wherein the first adapter seat 3 is provided with a first external connecting port 31, and the second adapter seat 4 is provided with a second external connecting port 41. The first external connecting port 31 is used as a refrigerant inlet, and the second external connecting port 41 is used as a refrigerant outlet. The heat exchange core 2 is further provided with a first external connecting pipe 5 and a second external connecting pipe 6, which are used as a coolant inlet and outlet.

The heat exchange core body 2 includes multiple mutually stacked plates, and multiple channels are formed between the mutually stacked plates, wherein a part of the channels are functioned as a first fluid channel (not shown in the figures), the refrigerant can flow within the first fluid channel, another part of the channels are functioned as a second fluid channel (not shown in the figures), and the coolant can flow within the second fluid channel. In the heat exchange core body 2, at least a part of the first fluid channel can be in a thermal contact state with the second fluid channel through the plates.

A partition plate 23 is also provided in the heat exchange core body 2. By providing the partition plate 23, the first fluid channel is divided into a first section 21 and a second section 22. In the heat exchange core body 2, the refrigerant of the first section 21 is not in direct communication with the refrigerant of the second section 22.

The first section 21 includes a first fluid collecting channel 211 and a second fluid collecting channel 212 which are located on opposite two sides of the first section 21. The second section 22 includes a third fluid collecting channel 221 and a fourth fluid collecting channel 222 which are located on opposite two sides of the second section 22. And the first fluid collecting channel 211 is arranged adjacent to the fourth fluid collecting channel 222. The first fluid collecting channel 211 and the fourth fluid collecting channel 222 are separated by the partition plate 23, the second fluid collecting channel 212 is arranged adjacent to the third fluid collecting channel 221, and the second fluid collecting channel 212 and the third fluid collecting channel 221 are also separated by the partition plate 23.

The first adapter seat 4 is arranged adjacent to the fourth fluid collecting channel 222, and the second external connecting port 41 is in communication with the fourth fluid collecting channel 222.

Figure 3:
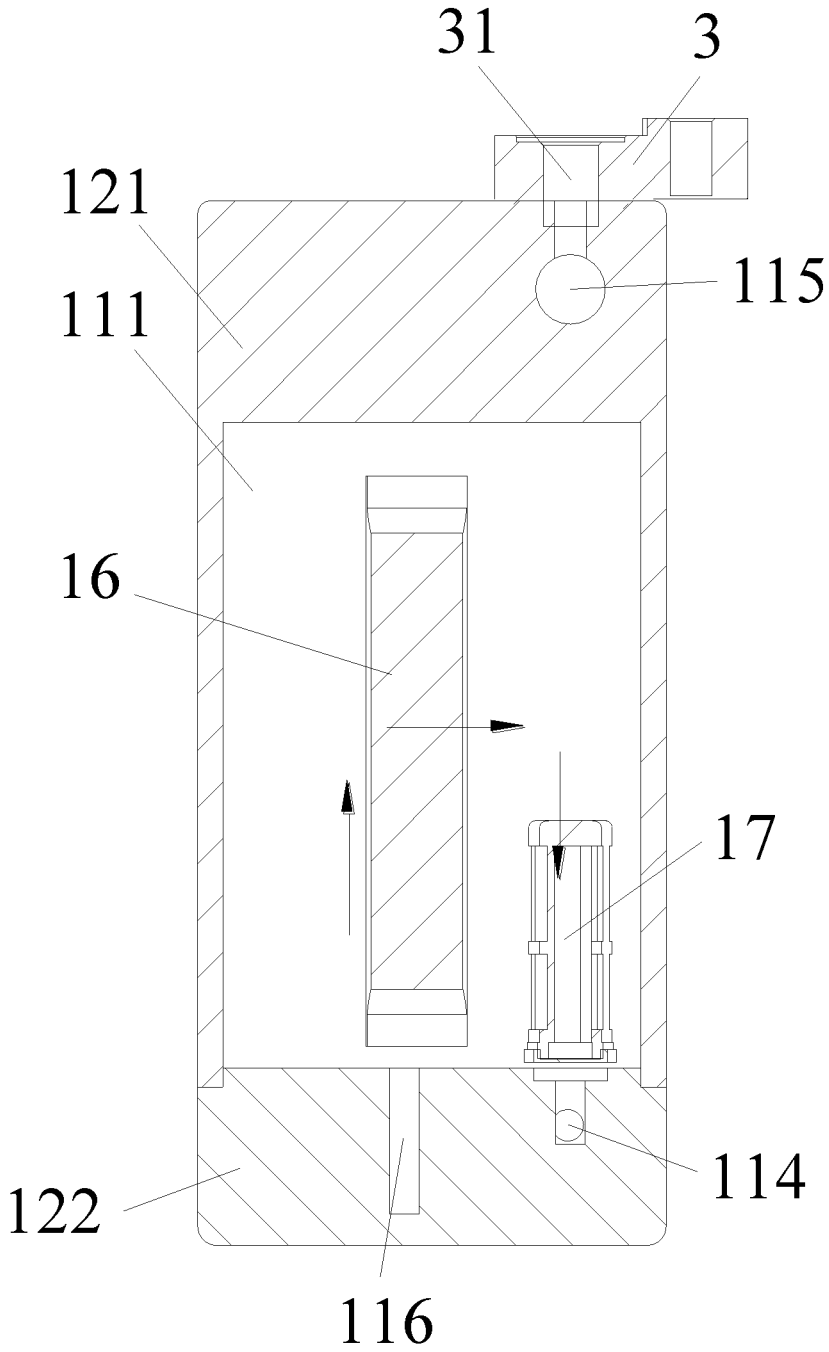
FIG. 3 is a schematic sectional view of the heat exchange device shown in FIG. 1 at another position.
Figure 4:
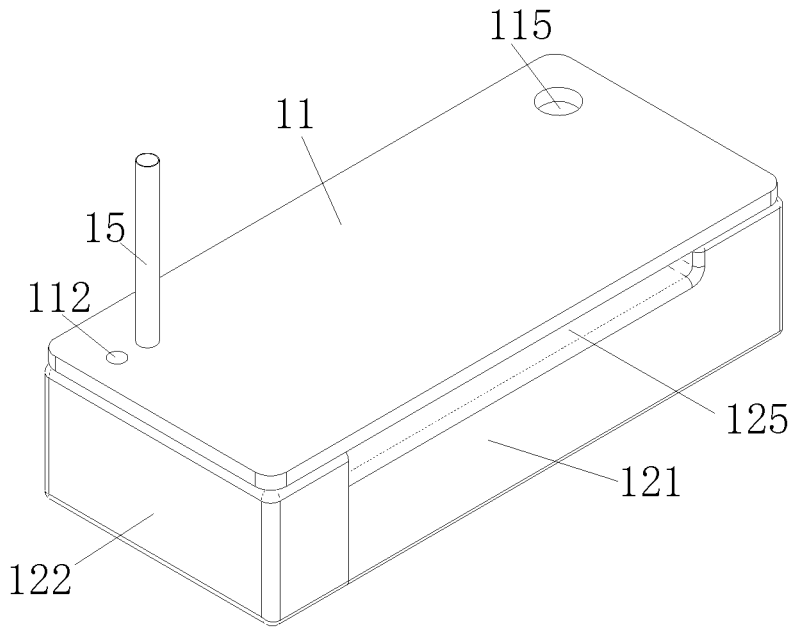
FIG. 4 is a schematic perspective view of an accumulator in the heat exchange device shown in FIG. 1.

The accumulator 1 is arranged on the outer side of the heat exchange core body 2, and the accumulator 1 and a side plate 11 of the heat exchange core body 2 can be directly fixed by welding. As shown in FIGS. 2 to 4, the accumulator 1 includes a housing 12. The housing 12 includes a first sub-housing 121 and a second sub-housing 122. In the present embodiment, one end of the first sub-housing 121 is open, an accommodating cavity 111 is arranged in the housing 12, an open end of the first sub-housing 121 is in communication with the accommodating cavity 111, and the open end of the first sub-housing 121 is covered by the second sub-housing 122. It should be noted that the accommodating cavity 111 may be located in the first sub-housing 121, the accommodating cavity 111 may also be located in the second sub-housing 122, or a part of the accommodating cavity 111 is located in the first sub-housing 121, another part of the accommodating cavity 111 is located in the second sub-housing 122. Besides, the structure adopted in the present embodiment is advantageous to form the first sub-housing 121 by stamping, and is also advantageous to process the inlet channel and the outlet channel in the second sub-housing 122 in a machining manner.

Herein, a portion of the housing corresponding to an opposite side of the open end of the first sub-housing is referred as the second thick wall portion 117, and a portion of the housing, corresponding to the second thick wall portion 117, of the second sub-housing is referred as the first thick wall portion 118. A wall thickness of the second thick wall portion 117 and a wall thickness of the first thick wall portion 118 are not less than the wall thickness of the rest housing, and this arrangement can reduce the material cost of the accumulator 1.

As shown in FIG. 2, the first adapter seat 3 is fixedly installed with the second thick wall portion 117, the second thick wall portion 117 is provided with an adapter channel 115, one end of the adapter channel 115 is in communication with the first external connecting port 31, and another end of the adapter channel 115 is in communication with the first fluid collecting channel 211. In the present embodiment, by providing the adapter channel 115 in the first sub-housing 121, an additional connecting member fixed with the first adapter seat 3 does not need to be arranged in the heat exchange core body, so that the housing and the heat exchange core body can be directly fixed through a furnace welding, and the processing is simple; and by welding as a whole, the sealing performance is good, and the risk of external leakage is relatively small. Apparently, it should be noted here that the second thick wall portion 117 and the first sub-housing 121 may also be provided in a separate structure in which the processing of the first sub-housing 121 is relatively simple, besides, such the separate structure allows the volume of the first sub-housing 121 and the second thick wall portion 117 to be small when the refrigeration system has a relatively small accommodating cavity for the accumulator 1, so that the material will not be wasted due to that the volume of the second thick wall portion 117 is too large.

Figure 5:
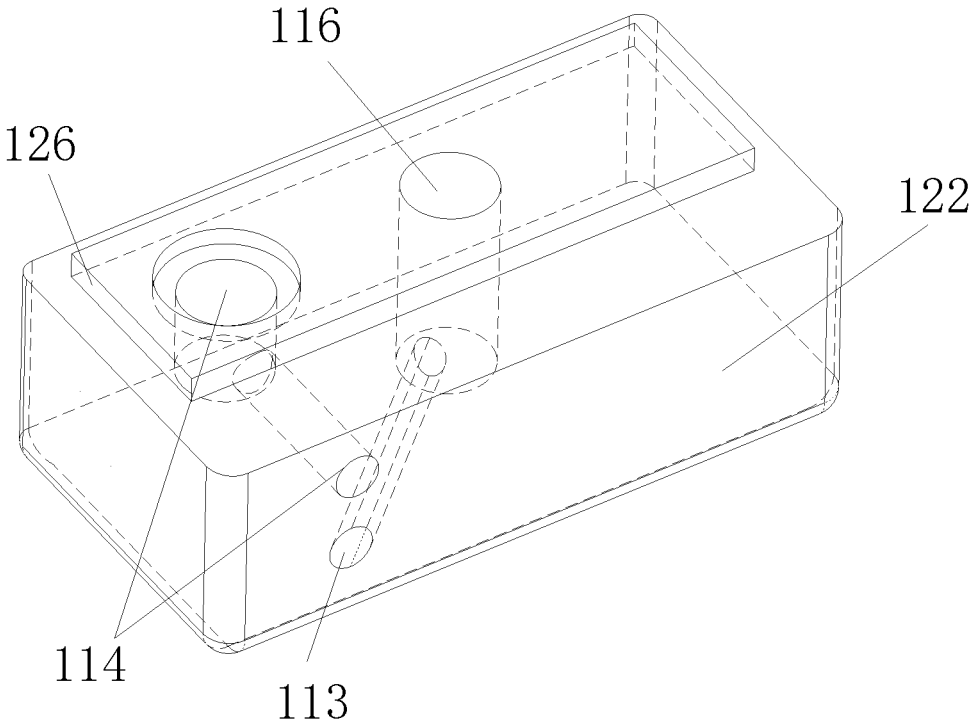
FIG. 5 is a schematic perspective view of a second sub-housing in the heat exchange device shown in FIG. 1.

As shown in FIGS. 2, 3 and 5, the first thick wall portion 118 is provided with an inlet channel. The inlet channel includes a first sub-channel 113 and a second sub-channel 116. The first sub-channel 113 is in communication with the second fluid collecting channel 212 through the connecting channel 112 of the side plate 11. In the heat exchange device, one end of the first sub-channel 113 is used as an inlet of the accumulator 1, one end of the connecting channel 112 of the side plate 11 is used as an outlet of the first section 21 of the first fluid channel. In the present embodiment, the housing 12 of the accumulator 1 is directly welded to the heat exchange core body 2 as a whole, one end of the first sub-channel 113 is in direct communication with one end of the second fluid collecting channel 212, and a connecting pipeline or other connecting component does not need to be arranged in the middle, which can reduce the flow resistance loss of the fluid and the energy loss of the refrigerant as much as possible, and further can relatively reduce the risk of external leakage. Another end of the first sub-channel 113 is in communication with one end of the second sub-channel 116, and another end of the second sub-channel 116 is in communication with the accommodating cavity 111.

The first thick wall portion 118 is also provided with an outlet channel 114. One end of the outlet channel 114 is fixedly installed with the filter 17 by a support 19, a port of the outlet channel 114 close to the filter 17 is arranged adjacent to a port of the second sub-channel 116, and another port of the outlet channel 114 is arranged adjacent to a port of the first sub-channel 113. And the adjacent two ports of the outlet channel 114 and the first sub-channel 113 are covered by a projection of the second fluid collecting channel 212 on the first thick wall portion 118. The first thick wall portion 118 is also provided with a boss portion 126 that can be used to position and install with the first sub-housing 121.

The accumulator 1 is also provided with a drowning pipe 15 that is in communication with the outlet channel 114. In the present embodiment, the drowning pipe 15 can be used as an outlet pipe of the accumulator 1 and an inlet pipe of the second section 22.

As shown in FIG. 2, a part of the drowning pipe 15 passes through the second fluid collecting channel 212 and the partition plate 23 and at least a part of the drowning pipe extends into the third fluid collecting channel 221. One end of the drowning pipe 15 is located in the third fluid collecting channel 221. The drowning pipe 15 passes through the partition plate and an outer wall of the drowning pipe 15 and the partition plate are sealed and fixed. And an outer diameter of the drowning pipe 15 is less than an inner diameter of the second fluid collecting channel 212 and an inner diameter of the third fluid collecting channel 221. Such that, in the present embodiment, the drowning pipe 15 can be used as an inlet pipe of the second section 22, and the first section 21 and the second section 22 being isolated from each other can be achieved in the heat exchange core body 2.

As shown in FIG. 2, the housing 12 is provided with a first matching portion 123, a second matching portion 124 and a recess 125. The first matching portion, the second matching portion and the recess are located on the same side of the housing. And the recess is located between the first matching portion 123 and the second matching portion 124, wherein the first matching portion 123 is located in the first sub-housing 121, the second matching portion 124 is located in the second sub-housing 122, and one end of the adapter channel 115 is located in the first matching portion 123, and one end of the inlet channel and one end of outlet channel are located in the second matching portion 124. The first matching portion 123 and the second matching portion 124 are fixed to the heat exchanging core body 2 by welding, and the recess 125 and the heat exchanging core body 2 remain at a certain distance. Such an arrangement mode facilitates the welding and sealing between the accumulator 1 and the heat exchange core body 2, the sealing performance is good, and the risk of inner leakage can also be reduced.

The working mode of the heat exchange device in the air conditioning system according to the embodiment is as follows. After entering from the first external connecting port 31, the refrigerant flows into the first fluid collecting channel 211 of the first section 21 of the heat exchange core body 2 through the adapter channel 115. The refrigerant exchanges heat with the coolant in the second fluid channel in the first section 21, after which the refrigerant passes through the second fluid collecting channel 212, the inlet channel and then flows into the accommodating cavity 111 of the accumulator 1 in sequence, then a part of the refrigerant is retained in the accumulator 1, and a part of the refrigerant flows out of the accumulator 1 through the drowning pipe 15 after being filtered by the filter 17. And the refrigerant flowing out of the accumulator 1 flow directly into the third fluid collecting channel 221 of the second section 22 of the heat exchange core body 2. The refrigerant exchanges heat with the coolant in the second fluid channel in the second section 22, and then the refrigerant flows out of the heat exchange device through the fourth fluid collecting channel 222 and the second external connecting port 41 in sequence. In the present embodiment, a portion of the heat exchange core body 2 corresponding to the first section 21 can be used as a condenser in the air conditioning system, and a portion of the heat exchange core body 2 corresponding to the second section 22 can be used as a supercooler in the air conditioning system.

In the present embodiment, the open end of the first sub-housing 121 is arranged downward. Such an arrangement can make the open end of the housing 121 larger, which is convenient for processing a mounting hole 116 and the third sub-channel 114, and can also make the accumulator 1 be flat, increasing the contact area between the accumulator 1 and the heat exchange core body 2, so that the size of the heat exchange device is small, and the anti-seismic performance of the heat exchange device can also be improved.

In the present embodiment, the second adapter seat 4, the first external connecting pipe 5 and the second external connecting pipe 6 are arranged on the same side, far away from the accumulator 1, of the heat exchange core body 2. Such an arrangement is reasonable, the second adapter seat 4, the first external connecting pipe 5 and the second external connecting pipe 6 are arranged away from the accumulator 1, so that the installation space of the accumulator 1 is large, especially when the large accumulator 1 is needed, for example, when the length and/or width of the accumulator 1 is greater than the length and/or width of the heat exchange core body 2, the accumulator 1 is prevented from interfering with the second adapter seat 4, the first external connecting pipe 5, the second external connecting pipe 6 and the like.

Only preferred embodiments of the present application are described above, and are not intended to limit the present application in any way. Although the present application has been disclosed as the preferred embodiment above, it should not be intended to limit the present application. Numerous possible alternations, modifications, and equivalents can be made to the technical solutions of the present application by those skilled in the art in light of the methods and technical content disclosed above without departing from the scope of the technical solution of the present application. Therefore, without departing from the content of the technical solution of the present application, any simple modifications, equivalents, and modifications made to the above embodiments according to the technical essential of the present application should fall within the protection scope of the technical solution of the present application.

What we claim is:

1. An accumulator, comprising a housing, a filter being arranged in the housing, wherein, the housing comprises a first sub-housing and a second sub-housing, an accommodating cavity is provided in the housing, the first sub-housing and the second sub-housing are sealedly fixed to form the accommodating cavity, the filter is arranged in the accommodating cavity, the housing is provided with a first wall portion, the first wall portion is located in the second sub-housing, an inlet channel and an outlet channel are provided in the first wall portion, one end of the inlet channel is in fluid communication with the accommodating cavity, and another end of the inlet channel is in fluid communication with an exterior of the housing, one end of the outlet channel is in fluid communication with the accommodating cavity through the filter, and another end of the outlet channel is in fluid communication with the exterior of the housing, and a port of the inlet channel in fluid communication with the exterior of the housing is arranged close to a port of the outlet channel in fluid communication with the exterior of the housing, wherein, the accumulator is of a flat shape, the housing is further provided with a second wall portion, the second wall portion is located in the first sub-housing, a first adapter seat is arranged in the second wall portion, the first adapter seat is provided with a first external connecting port, the second wall portion is provided with an adapter channel, and the first external connecting port is in fluid communication with the adapter channel.

2. The accumulator according to claim 1, wherein, the inlet channel comprises a first sub-channel and a second sub-channel, a part of one end of the first sub-channel located in an outer wall of the housing is functioned as an inlet of the accumulator, another end of the first sub-channel is in fluid communication with one end of the second sub-channel, another end of the second sub-channel is fluid in communication with the accommodating cavity, a support is arranged on one end of the outlet channel adjacent to the accommodating cavity, and the filter is fixedly installed with the outlet channel through the support.

3. The accumulator according to claim 2, wherein, the housing is further provided with a second wall portion, the second wall portion is located in the first sub-housing, a first adapter seat is arranged in the second wall portion, the first adapter seat is provided with a first external connecting port, the second wall portion is provided with an adapter channel, and the first external connecting port is in fluid communication with the adapter channel.

4. A heat exchange device, comprising a heat exchange core body and the accumulator according to claim 2, wherein, the heat exchange core body comprises a plurality of mutually stacked plates, a plurality of channels are formed between the mutually stacked plates, wherein a part of the plurality of channels are formed as a first fluid channel, another part of the plurality of channels are formed as a second fluid channel, a partition plate is further arranged in the heat exchange core body, the first fluid channel is divided into a first section and a second section by the partition plate, the first section comprises a first fluid collecting channel and a second fluid collecting channel, the second section comprises a third fluid collecting channel and a fourth fluid collecting channel, the second fluid collecting channel is in fluid communication with the inlet channel, and the outlet channel is in fluid communication with the third fluid collecting channel through a pipeline.

5. The accumulator according to claim 1, wherein, the housing is provided with a first matching portion, a second matching portion and a recess, wherein the first matching portion is located in the first sub-housing, the second matching portion is located in the second sub-housing, the first matching portion, the second matching portion and the recess are located on a same side of the housing, and the recess is located between the first matching portion and the second matching portion, one end of the adapter channel is located in the first matching portion, and one end of the inlet channel and one end of the outlet channel are located in the second matching portion.

6. A heat exchange device, comprising a heat exchange core body and the accumulator according to claim 1, wherein, the heat exchange core body comprises a plurality of mutually stacked plates, a plurality of channels are formed between the mutually stacked plates, wherein a part of the plurality of channels are formed as a first fluid channel, another part of the plurality of channels are formed as a second fluid channel, a partition plate is further arranged in the heat exchange core body, the first fluid channel is divided into a first section and a second section by the partition plate, the first section comprises a first fluid collecting channel and a second fluid collecting channel, the second section comprises a third fluid collecting channel and a fourth fluid collecting channel, the second fluid collecting channel is in fluid communication with the inlet channel, and the outlet channel is in fluid communication with the third fluid collecting channel through a pipeline.

7. The heat exchange device according to claim 6, wherein a drowning pipe is further arranged in the heat exchange device, a part of the drowning pipe passes through the second fluid collecting channel and the partition plate, and at least a part of the drowning pipe extends into the third fluid collecting channel, one port of the drowning pipe is located in the third fluid collecting channel, another end of the drowning pipe is in fluid communication with the outlet channel, an outer wall of the drowning pipe is sealedly fixed to the partition plate, and an outer diameter of the drowning pipe is less than an inner diameter of the second fluid collecting channel and an inner diameter of the third fluid collecting channel, and the outlet channel is in fluid communication with the third fluid collecting channel through the drowning pipe.

8. The heat exchange device according to claim 7, wherein, a port of the inlet channel in fluid communication with an exterior of the housing and a port of the outlet channel in fluid communication with an exterior of the housing are covered by a projection of the second fluid collecting channel on the first wall portion.

9. The heat exchange device according to claim 8, wherein, the housing is further provided with a second wall portion, the second wall portion is located in the first sub-housing, a first adapter seat is arranged in the second thick wall portion, the first adapter seat is provided with a first external connecting port, the wall portion is provided with an adapter channel, and the first external connecting port is in fluid communication with the adapter channel.

10. The heat exchange device according to claim 9, wherein, the housing is provided with a first matching portion, a second matching portion and a recess, wherein the first matching portion is located in the first sub-housing, the second matching portion is located in the second sub-housing, the first matching portion, the second matching portion and the recess are located on a same side of the housing, and the recess is located between the first matching portion and the second matching portion, one end of the adapter channel is located in the first matching portion, one end of the inlet channel and one end of the outlet channel are located in the second matching portion, the first matching portion is fixed with the heat exchanging core body by welding, the second matching portion is fixed with the heat exchanging core body by welding, and the recess is kept at a certain distance from the heat exchanging core body.

11. The heat exchange device according to claim 10, wherein, the accumulator is arranged on an outer side of the heat exchange core body, the housing is fixed with the heat exchange core body by welding, the heat exchange core body is further provided with a first external connecting pipe and a second external connecting pipe, the second adapter seat, the first external connecting pipe and the second external connecting pipe are arranged on the same side, far away from the accumulator, of the heat exchanging core body.

* * * * *